US005090089A

United States Patent [19]

Schulte et al.

[11] Patent Number: 5,090,089

[45] Date of Patent: Feb. 25, 1992

[54] AUTOMATIC DOOR CLOSING DEVICE

[75] Inventors: Ernst Schulte; Werner Korling, both of Menden; Franz Kraft, Arnsberg, all of Fed. Rep. of Germany

[73] Assignee: ECO Schulte GmbH & Co. KG, Menden, Fed. Rep. of Germany

[21] Appl. No.: 445,696

[22] PCT Filed: Jun. 10, 1988

[86] PCT No.: PCT/DE88/00347

§ 371 Date: Nov. 22, 1989

§ 102(e) Date: Nov. 22, 1989

[87] PCT Pub. No.: WO88/09860

PCT Pub. Date: Dec. 15, 1988

[30] Foreign Application Priority Data

Jun. 13, 1987 [DE] Fed. Rep. of Germany ..... 3719883
Oct. 16, 1987 [DE] Fed. Rep. of Germany ..... 3735010

[51] Int. Cl.[5] ..... E05F 3/00

[52] U.S. Cl. ..... 16/49; 16/51; 16/58; 16/82

[58] Field of Search ..... 16/49, 51, 58, 66, 71, 16/DIG. 21, DIG. 9, 52

[56] References Cited

U.S. PATENT DOCUMENTS

| | | | |
|---|---|---|---|
| 3,079,629 | 3/1963 | Millard | 16/52 |
| 3,574,886 | 4/1971 | Solovizfe | 16/58 |
| 3,584,331 | 6/1971 | D'Hooge | 16/51 |
| 3,887,961 | 6/1975 | Saajos | 16/51 |
| 3,913,170 | 10/1975 | Nakane | 16/52 |
| 4,115,897 | 9/1978 | Zunkel | 16/49 |
| 4,601,502 | 7/1986 | Van Dyke | 16/82 |

FOREIGN PATENT DOCUMENTS

| | | |
|---|---|---|
| 3204975 | 5/1983 | Fed. Rep. of Germany . |
| 2311919 | 12/1976 | France . |

*Primary Examiner*—Richard K. Seidel
*Assistant Examiner*—Chuck Y. Mah
*Attorney, Agent, or Firm*—Collard, Roe & Galgano

[57] ABSTRACT

To simplify the fabrication of the housing of an automatic door closing device with hydraulic damping, it is proposed to configure the housing as a tubular hollow cylinder 106 on which, externally, by means of one or more compactly superimposed covering elements 102, a bypass valve 121 is formed.

5 Claims, 6 Drawing Sheets

AUTOMATIC DOOR CLOSING DEVICE

Figure 1:
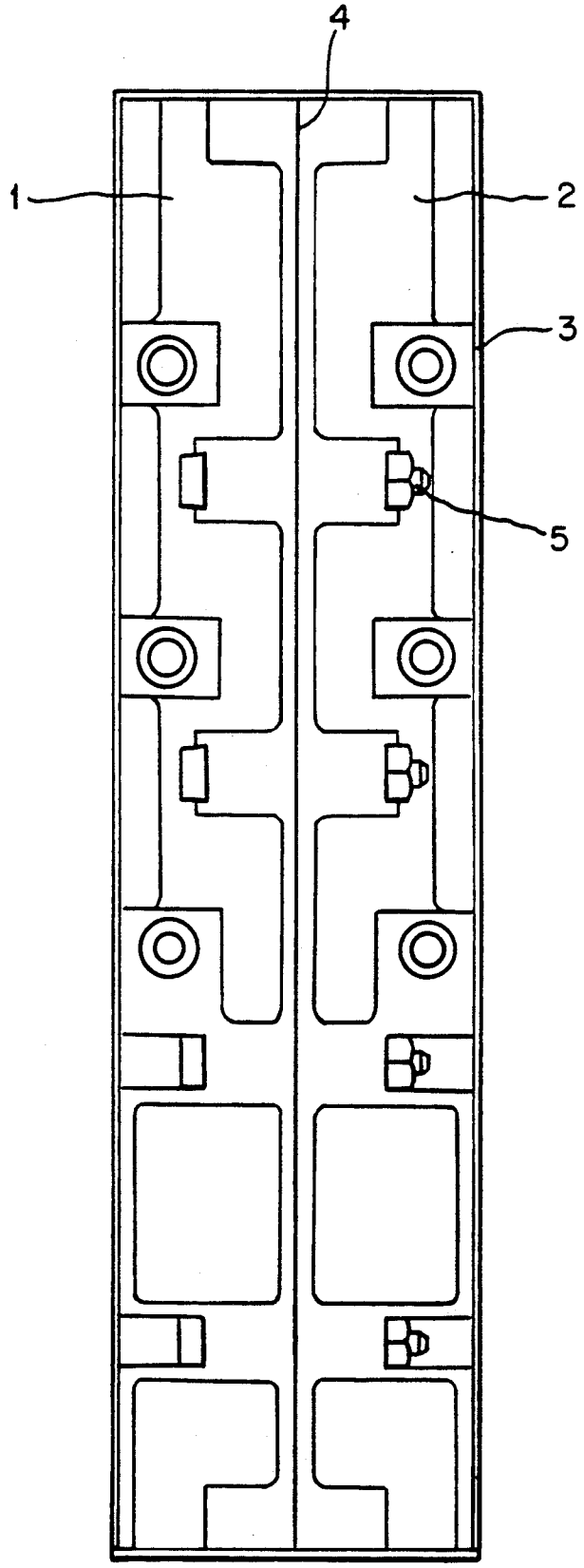

The invention relates to an automatic door closing device according to the preamble of claim 1. It preferably concerns tooth-wheel drive door closing devices or crank-gear door closing devices in accordance with German Industry Standards (DIN) 18,263. Said door closing devices are used in fire protection doors, smoke protection doors and residential main locking front-/back doors. The requisite energy for the automatic closing is, as a rule, stored in a propeller thrust spring. The closing movement is damped by means of hydraulic throttling. In this connection the externally controlled displaceable hydraulic plunger is arranged between radial throttle bores which are interconnected via a bypass valve which connects, respectively, a pressurized space inside the cylinder in front of the plunger to an unpressurized space behind the plunger via a throttle valve.

Among the door closing devices of this kind known in the art, the damping cylinder, which concurrently forms the housing of the door closing device, is of a single-piece construction, either as a pressure diecast enclosure or as a segment of a corresponding extruded hollow section, preferably consisting of a light metal. Fabrication of such cylinders, as regards the reception for the damping plunger, which must be performed to close tolerances, and the required long bypass valves and with respect to the throttle bores, is difficult and demands specialized tooling machines. As a consequence of the high pressures which result, fabrication of the reception for the damping plunger must be performed to very high tolerances. Fabrication difficulties are particularly encountered with the bypass valve which, as a rule, extends parallel to the damping plunger in the single-piece cylinder and which must be precisely connected to the transversely arrayed throttle bores from the outside or from the inside.

German Patent Specification 931,696 has already proposed arranging a tubular line serving as a bypass valve externally on a special damping plunger which functions to damp a door closing device accommodated in a separate housing. Such an externally located bypass line, however, is inconvenient.

German Patent Specification 826,849 discloses a method for joining, through casting, an added piece with an integrally cast bypass line onto the damping cylinder configured as a housing of an automatic door closing device. Tubular sections have also been integrally cast as a cylinder reception in the housing formed as a casting body. Fabrication of such door closing device housings has proven costly and difficult. It requires precise setting up of the tubular sections in the casting mould. The resulting housing itself is relatively voluminous.

German Patent Specification A 1,584,167 discloses a technique whereby a hollow cylinder is concentrically arrayed on the damping cylinder. The ring slot formed functions as a bypass valve for the hydraulic fluid. The relatively large cross-section of the ring slot, however, does not permit adequate throttle control. Fabrication costs are high.

The task of the invention consists in simplifying, from the production engineering standpoint, an automatic door closing device of the kind designated at the outset.

The task of the invention is solved on the basis of a door closing device displaying all the characteristic features of claim 1.

In accordance with the proposal according to the invention, factory-manufactured sections of tubing can be used for the damping cylinders, which sections, as regards plunger reception, have already been sufficiently tooled to close tolerances. By virtue of the formation of the bypass valve between the outside of the tubular damping cylinder and the compactly superimposed covering element, the intricate bores in the damping cylinder heretofore required are eliminated. The covering elements which conform to the external shape of the tubular damping cylinder only necessitate a very slight enlargement of the outside diameter of the cylinder.

According to a preferred embodiment of the invention according to claim 2, a groove serving as a covering element has been welded externally onto the tubular damping cylinder, which groove exhibits a hollow space which is outwardly coined and which, in the direction of the tubular hollow cylinder, forms the bypass valve. Such covering elements can be bonded to the tubular hollow cylinder by means of a welding process known in the art without thermal stresses affecting the cylinder reception which has close tolerances.

In accordance with claim 3, the invention also proposes configuring the respective covering element as a single piece with the adjacent throttle valve housing, with the result that, in this instance, both possible individual elements are superimposed together in sealed off fashion and can be bonded, preferably by means of a weld connection.

Figure 2:
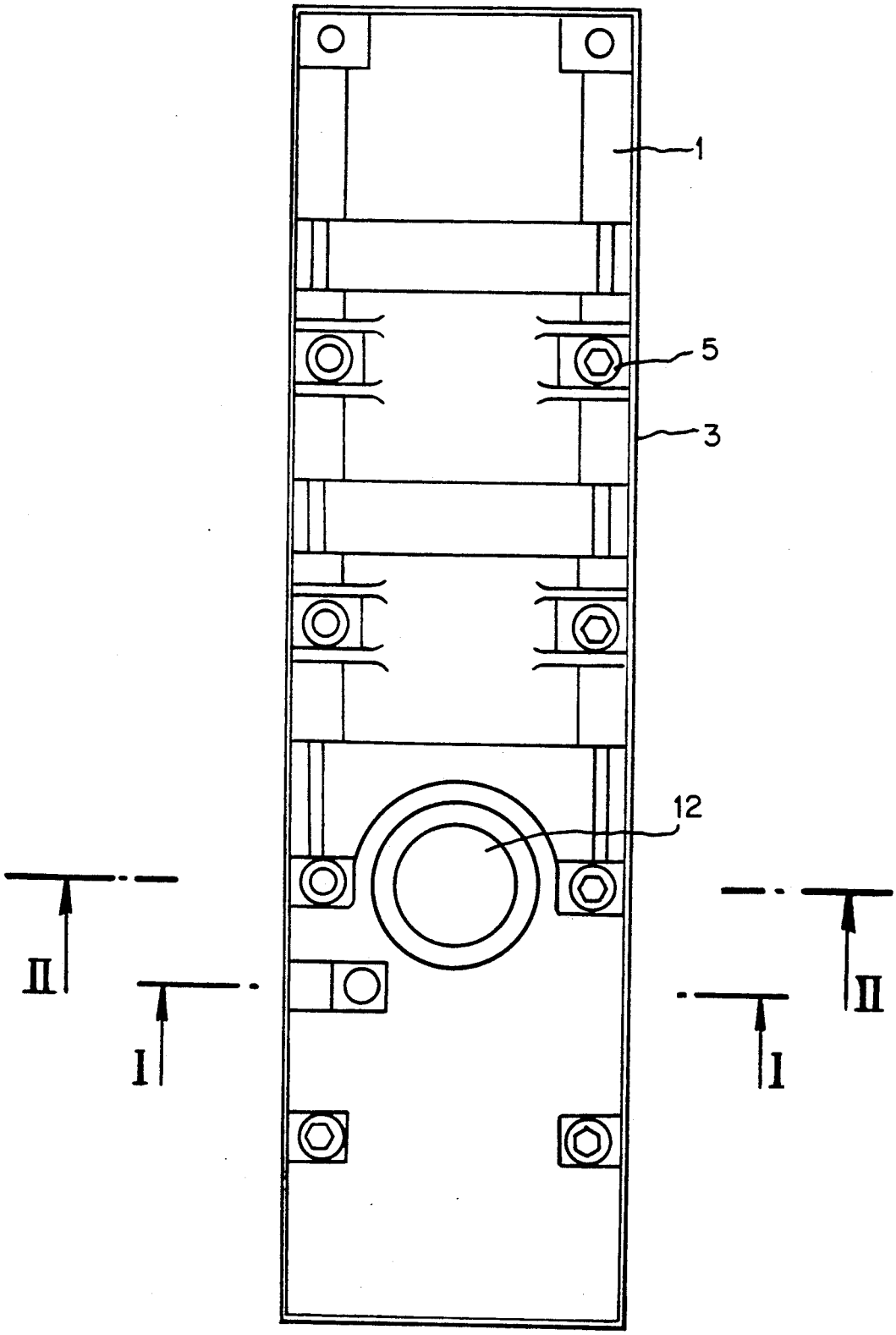
Figure 3:
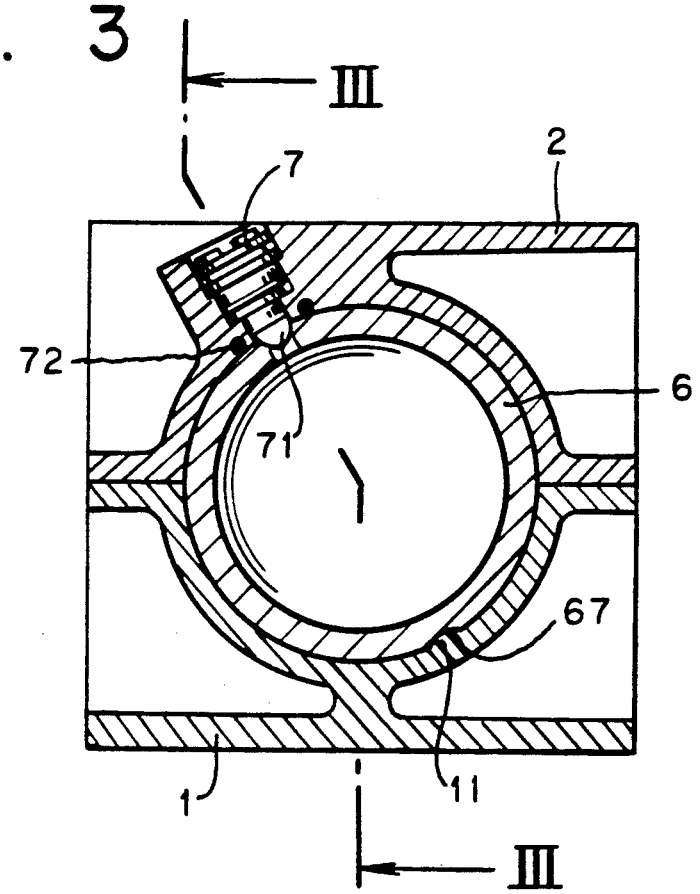
Figure 4:
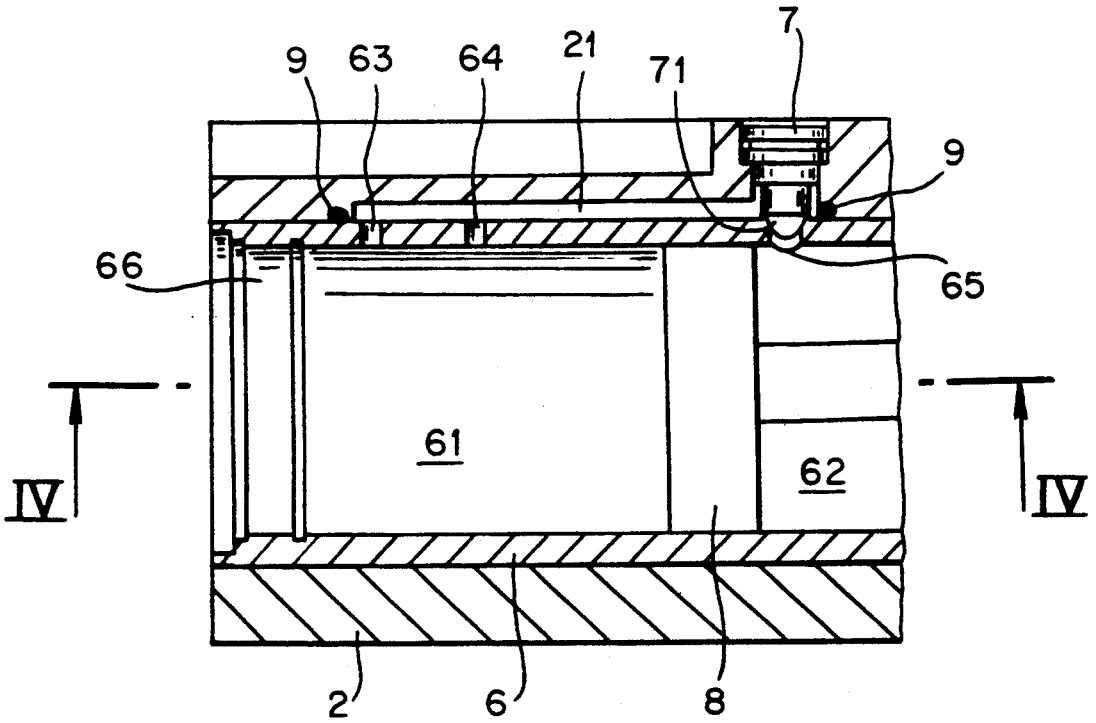
Figure 5:
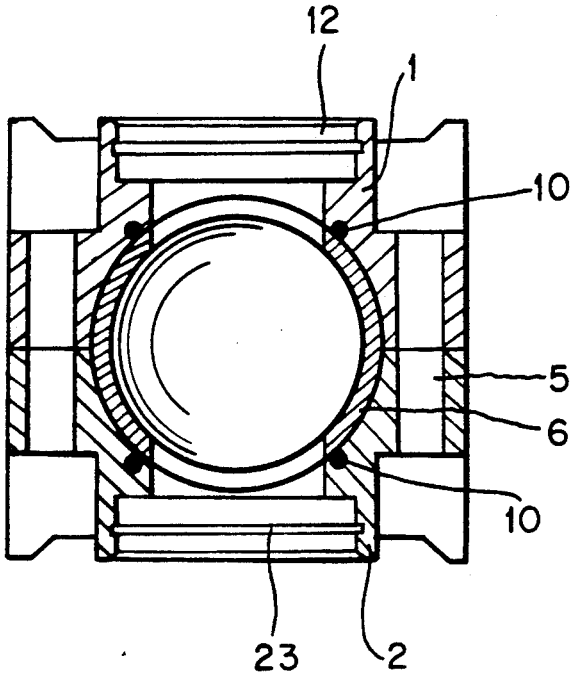
Figure 6:
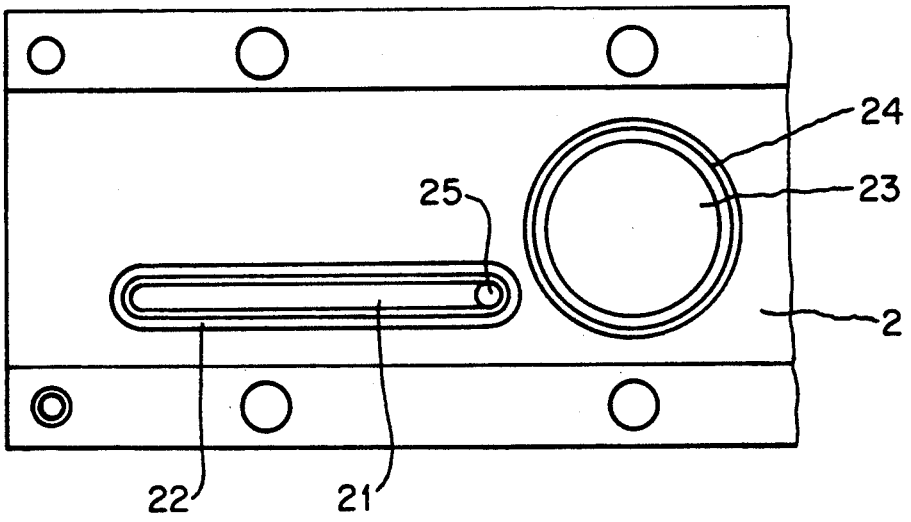
Figure 9:
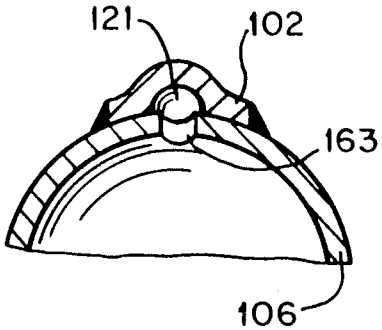
Figure 8:
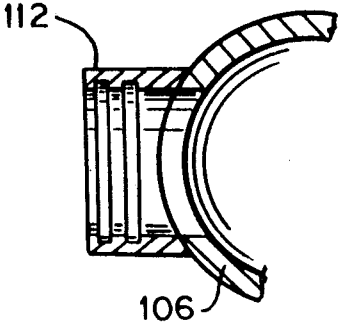
Figure 7:
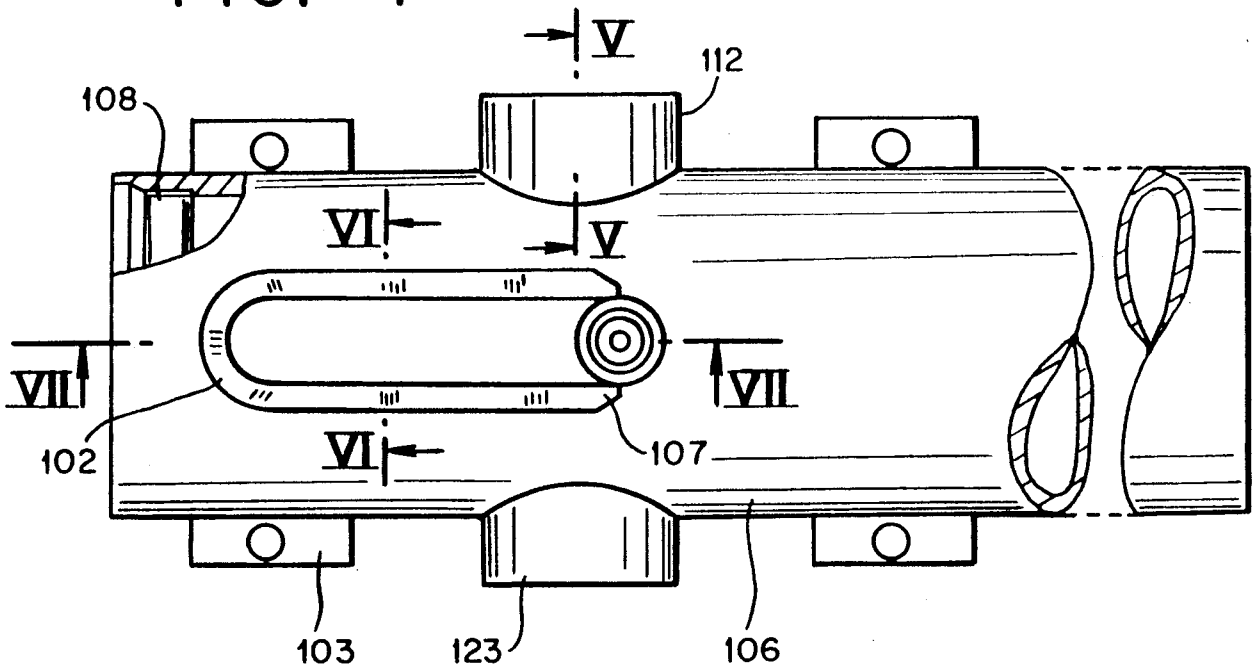
Figure 10:
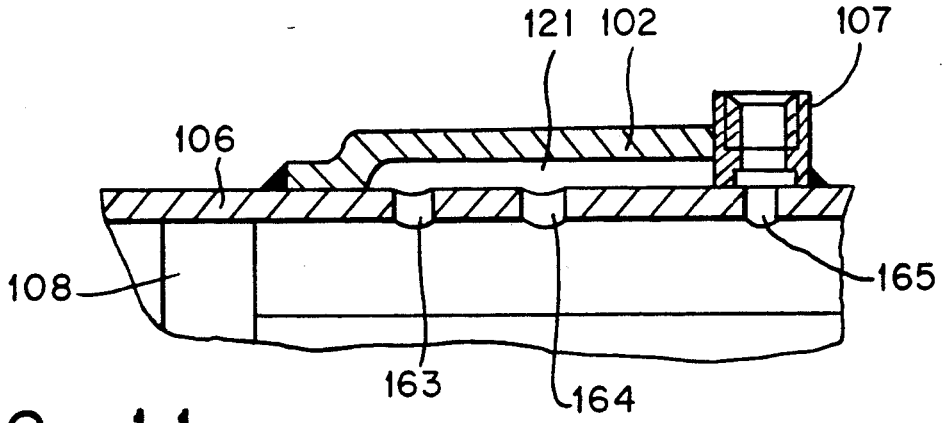
Figure 11:
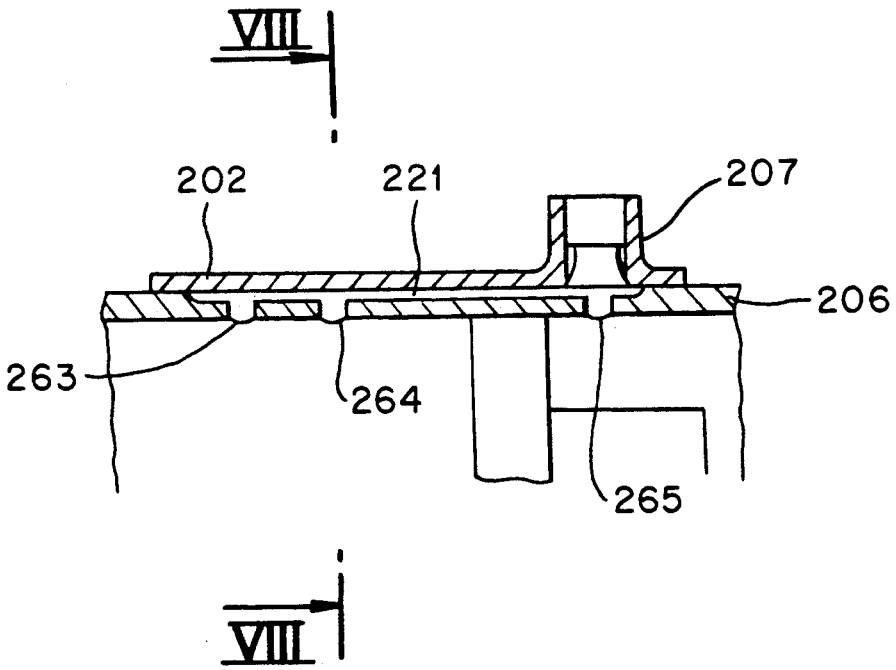
Figure 12:
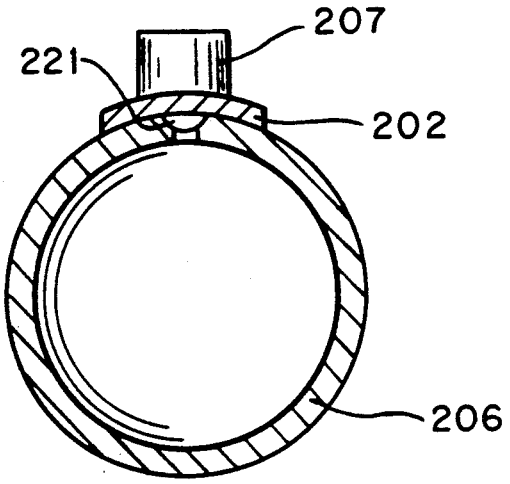

On the basis of the practical embodiments shown in the drawings, the invention is described hereinafter in greater detail. Shown are:

FIG. 1 the front view of the housing of a door closing device in a monocoque construction, FIG. 2 the top view onto the housing in FIG. 1, FIG. 3 a section along the I—I line in FIG. 2, FIG. 4 a section along the III—III line in FIG. 3, FIG. 5 a section along the II—II line in FIG. 2, FIG. 6 a section along the IV—IV line in FIG. 4 without the tubular hollow cylinder, FIG. 7 a top view onto another door closing device housing, FIG. 8 a partial section along the V—V line in FIG. 7, FIG. 9 a partial section along the VI—VI line in FIG. 7, FIG. 10 a partial section along the VII—VII line in FIG. 7, FIG. 11 a partial longitudinal section through another door closing device housing in the area of the bypass valve formed and FIG. 12 a section along the VIII—VIII line in FIG. 11.

Reference shall be made initially to the FIGS. 1-6. Two half shells form a cylinder reception in which, having been positioned and sealed off, a tubular hollow cylinder 6, which forms the door closing device housing, is accommodated in form-locking manner. The housing shells in said configuration lie in a jointing plane 4 against each other. Reference No. 3 designates an additional covering which is depicted as dashed lines. Both half shells 1 and 2 are braced against each other via the bolt connections 5.

The tubular hollow cylinder 6, at its end, is sealed off by the stopper 66. In the hollow cylinder 6 a hydraulic plunger 8, which via a corresponding connection rod or the like (not illustrated) is displaceable, separates a pressurized space 61 from an unpressurized space 62. As FIG. 4 illustrates, two radial throttle bores 63 and 64 open out into the pressurized space, which bores open out into a bypass valve 21 in the half shell 2 which is parallel to the cylinder axis.

As can be appreciated from FIGS. 4 and 6, said bypass valve 21, in the direction of the tubular hollow cylinder 6, is formed in the cylinder reception of the half shell 2 in an open, slot-like manner. A sealing reception 22 is formed in around the bypass valve, in which seal reception a section seal 9 is fitted. Other types of seals can be used at this point as well.

The bores 23 and 12, which may be seen in FIGS. 5 and 6, which provide the lead-in of the drive rod, are also enveloped by a seal reception 24. The seals which are to be arranged in said seal reception are shown in FIG. 5. In order to lead in said rod, for example, a tooth-wheel drive, the tubular hollow cylinder 6 is also recessed at the appropriate places.

During the closing movement of a door equipped with such a door closing device, the hydraulic plunger 8 is displaced in the direction of the sealing stopper 66. Hydraulic fluid flows out of the pressurized space 61 through the throttle bores 63 and 64 via the bypass valve 21 to the throttle valve 7 and from this valve to the unpressurized space 62. The throttle valve 7 extends with its valve cone 71 into the bore 65 which is configured as a valve seat on the hollow cylinder 6. The throttle valve 7 is radially inserted into the half shell 2 with the seal 62 and can be externally adjusted.

As can be seen in FIG. 3, the hollow cylinder 6 is positioned between the half shells 1 and 2. A cam 11 provided in the half shell 1 grips a corresponding recess 67 externally on the hollow cylinder 6.

A design which, from the production engineering standpoint, constitutes a more cost-effective design of a housing of door closing device is shown in FIGS. 7–10. The housing is formed by the tubular hollow cylinder 106 which can be a section of factory-manufactured tubing with an interior diameter tooled to close tolerances. The hollow cylinder, internally, forms the reception for the hydraulic plunger 108. To form the hydraulic damping, both throttle bores 163 and 164 are provided in a radial direction. The bypass valve 121 is externally arrayed on the hollow cylinder 6. It is formed by the groove 102 which is solidly bonded to the tubular hollow cylinder 106 by means of a suitable welding process. Connected to the groove 102, the throttle valve 107 or its valve housing is superimposed. This housing, too, can be bonded by means of a weld connection or another, suitable connection. The bypass valve 121 thus formed connects the throttle bores 163 and 164 to the bore 165 to the unpressurized space. The valve cone of the throttle valve 107 acts against said bore 165.

Bushings 112 and 123 are arranged transversly to the axis on the hollow cylinder 106 to effect the sealed seating of a rod, for example, to drive a tooth-wheel drive to displace the hydraulic plunger 108. Side bar fasteners 103 secure the housing.

FIGS. 11 and 2 illustrate the tubular hollow cylinder 206 of an automatic door closing device in which, in order to form the bypass valve 221, externally, in the area of the throttle bores 263, 264 and 265, a slot-like recess is provided. A sealed semi-shell-shaped covering element or a gutter 202 is superimposed above this recess and preferably bonded thereto by means of a weld connection. The covering element 202 is already materially uniformly interconnected to the housing of the throttle valve 207.

We claim:

1. An automatic door closer comprising:

a closing spring loading a closing shaft;

a damping piston serving for damping the closing motion and which under external action is able to be moved in a damping cylinder between radial holes;

said radial holes are connected with each other via at least one transfer duct arranged outside the damping cylinder so that a damping fluid may flow from a pressure space in the cylinder ahead of the piston into a pressure-free space behind the piston via a choke valve;

said transfer duct is formed by a covering element mounted in a sealing manner directly externally on the damping cylinder; and wherein said covering element is a gutter externally welded on the damping cylinder as a covering element and with an externally pressured cavity opening towards the damping cylinder which with the damping cylinder forms the transfer duct.

2. The door closer as claimed in claim 1, characterized in that the housing of a choke valve adjoins the covering element.

3. The door closer as claimed in claim 1, characterized in that the damping cylinder is a section of a prefabricated tube.

4. The door closer as claimed in claim 3, characterized in that the damping cylinder simultaneously forms the housing of the door closer.

5. An automatic door closer comprising:

a closing spring loading a closing shaft;

a damping piston serving for damping the closing motion and which under external action is able to be moved in a damping cylinder between radial holes;

said radial holes are connected with each other via at least one transfer duct arranged outside the damping cylinder so that a damping fluid may flow from a pressure space in the cylinder ahead of the piston into a pressure-free space behind the piston via a choke valve;

said transfer duct is formed by a covering element mounted in a sealing manner directly externally on the damping cylinder; and wherein the damping cylinder is a tubular hollow cylinder having an axis, and a groove forming the transfer duct is formed externally on the tubular hollow cylinder parallel to the axis and which has a covering element sealed over it.

* * * * *